US008213668B2

(12) United States Patent
Tsao et al.

(10) Patent No.: US 8,213,668 B2
(45) Date of Patent: Jul. 3, 2012

(54) IN-EAR EARPHONE

(75) Inventors: Ching-Jung Tsao, Taichung (TW); I-Ming Lin, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 783 days.

(21) Appl. No.: 12/264,302

(22) Filed: Nov. 4, 2008

(65) Prior Publication Data

US 2010/0111348 A1 May 6, 2010

(51) Int. Cl.
*H04R 25/00* (2006.01)

(52) U.S. Cl. ..... 381/380; 381/370; 381/381; 381/382

(58) Field of Classification Search ..... 381/370, 381/380–382
See application file for complete search history.

(56) References Cited

U.S. PATENT DOCUMENTS

| | | | | |
|---|---|---|---|---|
| 2002/0080990 | A1* | 6/2002 | Lin | 381/380 |
| 2007/0098201 | A1* | 5/2007 | Chen | 381/380 |
| 2008/0031481 | A1* | 2/2008 | Warren et al. | 381/322 |
| 2008/0107299 | A1* | 5/2008 | Lin | 381/380 |
| 2008/0267438 | A1* | 10/2008 | Chen et al. | 381/345 |
| 2009/0116677 | A1* | 5/2009 | Jones et al. | 381/380 |
| 2009/0136074 | A1* | 5/2009 | Chang et al. | 381/380 |
| 2009/0233652 | A1* | 9/2009 | Yang | 455/569.1 |
| 2009/0279729 | A1* | 11/2009 | Huang | 381/345 |
| 2010/0177904 | A1* | 7/2010 | Sung et al. | 381/71.6 |

FOREIGN PATENT DOCUMENTS

| | | | |
|---|---|---|---|
| CN | 2415568 | Y | 1/2001 |
| JP | 4-348166 | * | 12/1992 |
| JP | 2004-148186 | * | 6/2006 |
| TW | 273162 | * | 8/2005 |
| TW | 273162 | U | 8/2005 |

* cited by examiner

*Primary Examiner* — A. Sefer
(74) *Attorney, Agent, or Firm* — Chun-Ming Shih

(57) ABSTRACT

An in-ear earphone includes a shell and a sound output device. The shell has a first engaging portion. The sound output device has a sound tunnel, a second engaging portion and a speaker. The speaker is disposed between the sound tunnel and the second engaging portion coaxially with the sound tunnel. The second engaging portion is movably engaged with the first engaging portion. The angle between the shell and the sound output device is adjustable so that the sound tunnel can be suitably plugged into individual user's ear canals.

12 Claims, 6 Drawing Sheets

1

IN-EAR EARPHONE

BACKGROUND

1. Field of the Invention

The present invention relates to an in-ear earphone, and more specifically, to an in-ear earphone that can be adjusted in wearing angles so as to meet individual comfort.

2. Description of Related Art

With the increasingly wide use of mobile phones and MP3 players, almost everyone has one of such devices today. Be it taking a phone call or listening to MP3 music, an earphone is the most direct media for receiving vocal or musical signals. In terms of the format of the earphones, there have been a great number of variations in recent years. There is an ear-muffs type of earphones, which completely cover the users' ears. There is also an ear-plug type of earphones, which can be plugged into the users' ears. Both types have their customer bases yet the ear-plug type of earphones is particularly popular because of its small size, light weight, and good usability and portability.

However, for the ear-plug type of earphones, although they are relatively small and convenient to wear, everyone's ear is different. As a result, when the ear-plug is plugged into the ears, the ear-plug earphone may fall out from the ears. In addition, because the ear-plug type of earphones may not completely fit the user's ears, when people using it to listen to music, the sound quality may be degraded by the ambient noise.

There have been some improved products in the market. Taiwan Patent No. 421412 discloses a so-called in-ear earphone. A hollow screwing plug is fixedly disposed on the outside of the main body of the earphone. The outside of the hollow screwing plug has a screw portion for plugging into the user's ear canals. A bass compression tube that is connected through the speaker is formed inside of the hollow screwing plug. In this way, the sound produced by the speaker can be transmitted to a position close to the eardrum in the canal through the bass compression tube. In addition, because the screwing portion is plugged to the canal, the earphone can be stably worn and disturbance from the ambient noise can be avoided.

The in-ear earphone can be fixedly worn by the screw portion that is plugged into the canal, however, the canal's angles of each user is different. The speaker which produces sound is located outside of the canal, the weight of the main body of the earphone and the speaker may make the user uncomfortable with a tilted angle after long time of use. Hence the compatibility of such earphones still needs to be improved.

BRIEF SUMMARY

An object of the present invention is to provide an earphone that can be adjusted in wearing angles so as to meet individual comfort.

An in-ear earphone according to a preferred embodiment of the present invention is provided. The earphone includes a shell and a sound output device. The shell has a first engaging portion. The sound output device has a sound tunnel, a second engaging portion and a speaker. The speaker is disposed between the sound tunnel and the second engaging portion coaxially with the sound tunnel. The second engaging portion is movably engaged with the first engaging portion. The angle between the shell and the sound output device is adjustable so that the sound tunnel can be suitably plugged into individual user's ear canals.

In a preferred embodiment of present invention, the first engaging portion of the in-ear earphone is a cell that roughly has a ball shape. The second engaging portion is combined with an end of the sound tunnel to form a rough ball shape. As a result, when the second engaging portion is combined with the first engaging portion, angular adjustments between the sound output device and the shell can be made.

In another preferred embodiment of the present invention, the second engaging portion of the in-ear earphone has a tube shape, an end of which is connected to the sound tunnel and another end of which has a cell that has a curved surface. The first engaging portion has a roughly ball shape and is combined within the cell so that angular adjustments between the sound output device and the shell can be made.

In the above embodiments, the sound output device, which can be plugged into a user's ear canal, of the in-ear earphone according to the embodiments of the present invention can be adjusted in its angle with the shell of the earphone so that when different users use the earphone, the users can adjust the sound output device to make it fit their own ear canals. Because the speaker is disposed in the sound output device, the direction in which the speaker outputs sound to the sound tunnel do not vary with the angular adjustment of the sound output device. As a result, the sound output characteristics of the earphone are not disturbed by the adjustment.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
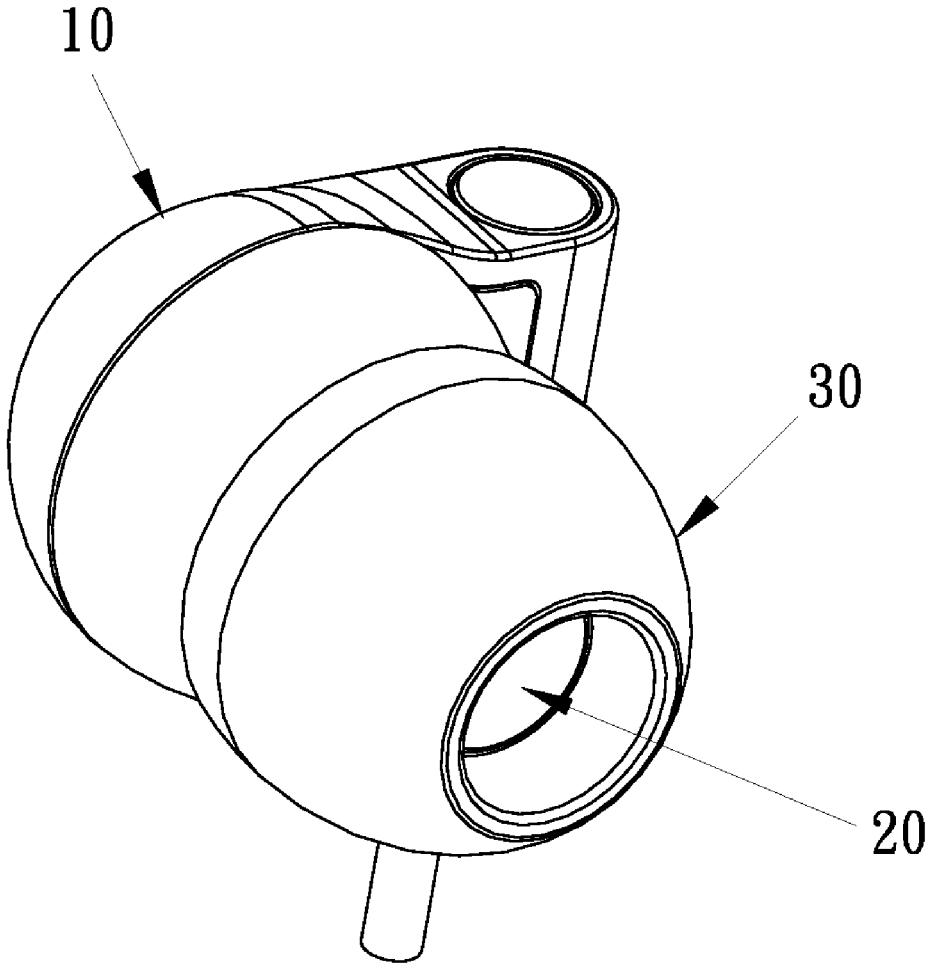
FIG. 1 is a perspective view of an in-ear earphone according to a preferred embodiment of the present invention.
Figure 2:
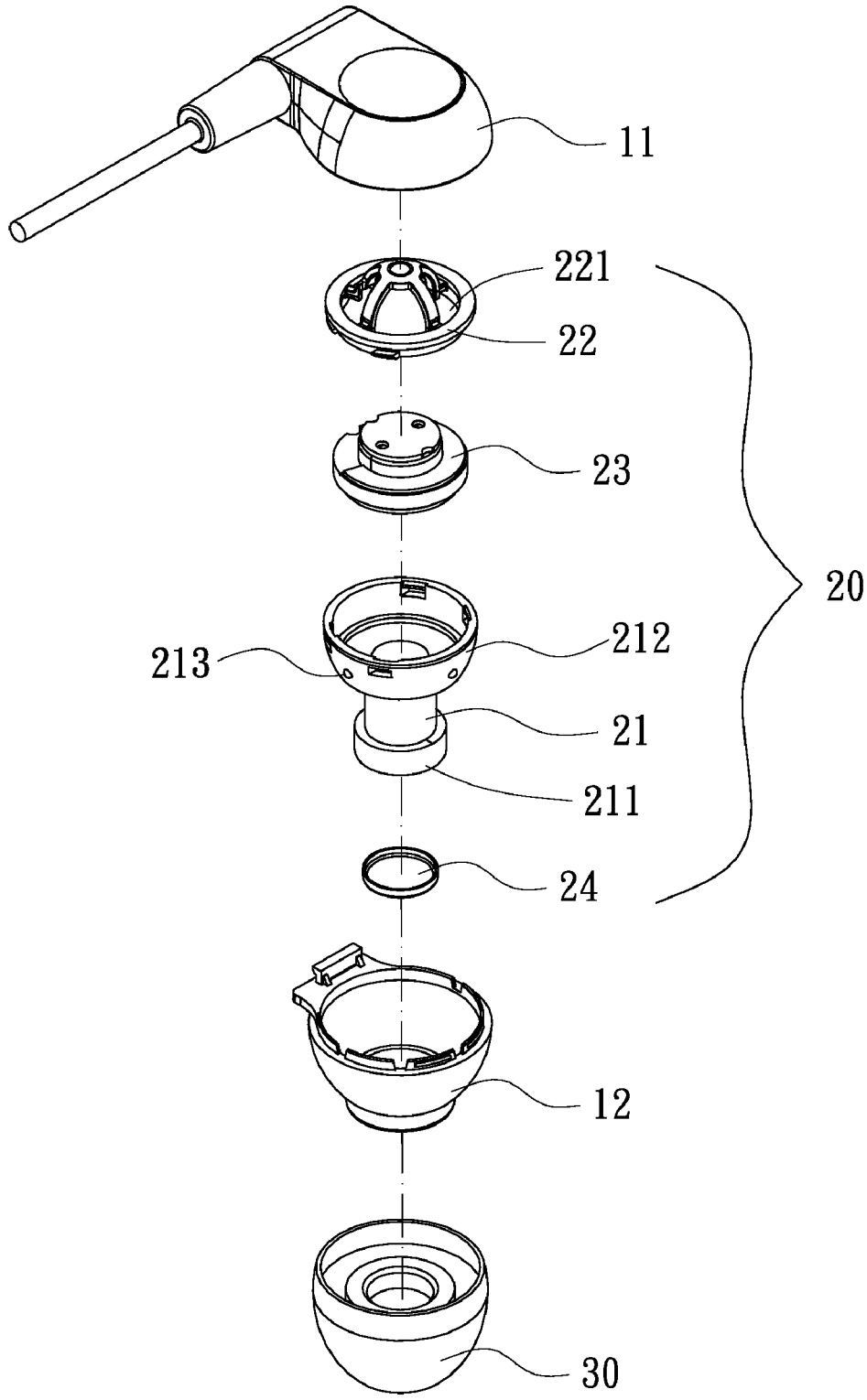
FIG. 2 is an exploded perspective view of the in-ear earphone depicted in FIG. 1.

Referring to FIG. 1 and FIG. 2, an in-ear earphone 1 according to a preferred embodiment of the present invention is provided. The in-ear earphone 1 includes a shell 10, a sound output device 20 and a cushion 30. One end of the sound output device 20 is moveably disposed in the shell 10, and another end of the sound output device 20 is wrapped around by the cushion 30.

In this embodiment, the shell 10 has a base 11 and a cover 12. The base 11 and the cover 12 both have a half spherical surface respectively. When the cover 12 is covered on the base 11, such half spherical surface is connected to form a cell that roughly has a ball shape. This cell functions as a first engaging portion 111, referring to FIG. 3, for accommodating the sound output device 20.

The sound output device 20 has a sound tunnel 21, a second engaging portion 22, a speaker 23 and a grid cover 24. The sound tunnel 21 has an opening end 211 and a containing portion 212. The grid cover 24 is disposed inside the opening end 211 for preventing dust from entering the sound tunnel 21. The outside of the opening end 211 is wrapped around by a cushion 30. The cushion 30 is made of an elastic material that is particularly suitable for being plugged into user's ear canals. The containing portion 212 of the sound tunnel 21 has a radius greater than the radius of the opening end 211 so as to accommodate the speaker 23. A sound outputting surface of the speaker 23 is installed to be facing the opening end 211 and the speaker 23 is coaxially aligned with the sound tunnel 21. The second engaging portion 22 is a cover of a half ball shape, on which there are four positioning holes 221 are formed. Referring to FIG. 2, the outside wall of the containing portion 212 of the sound tunnel 21 also has a curved shape. When the second engaging portion 22 is covered on the containing portion 212 of the sound tunnel 21, the curved surfaces are combined to form a shape close to a ball. This ball is further combined with the first engaging portion 111 of the shell 10 and accommodated inside the shell 10. The second engaging portion 22 can be adjusted in angles relative to the first engaging portion 111.

The sound tunnel 21 is made of polyoxymethylene (POM) or acrylonitrile butadiene styrene (ABS). The second engaging portion 22 is made of acrylonitrile butadiene styrene (ABS) or polyoxymethylene (POM), which acrylonitrile butadiene styrene (ABS) is soft and polyoxymethylene (POM) is suitable for rubbing against.

Figure 3:
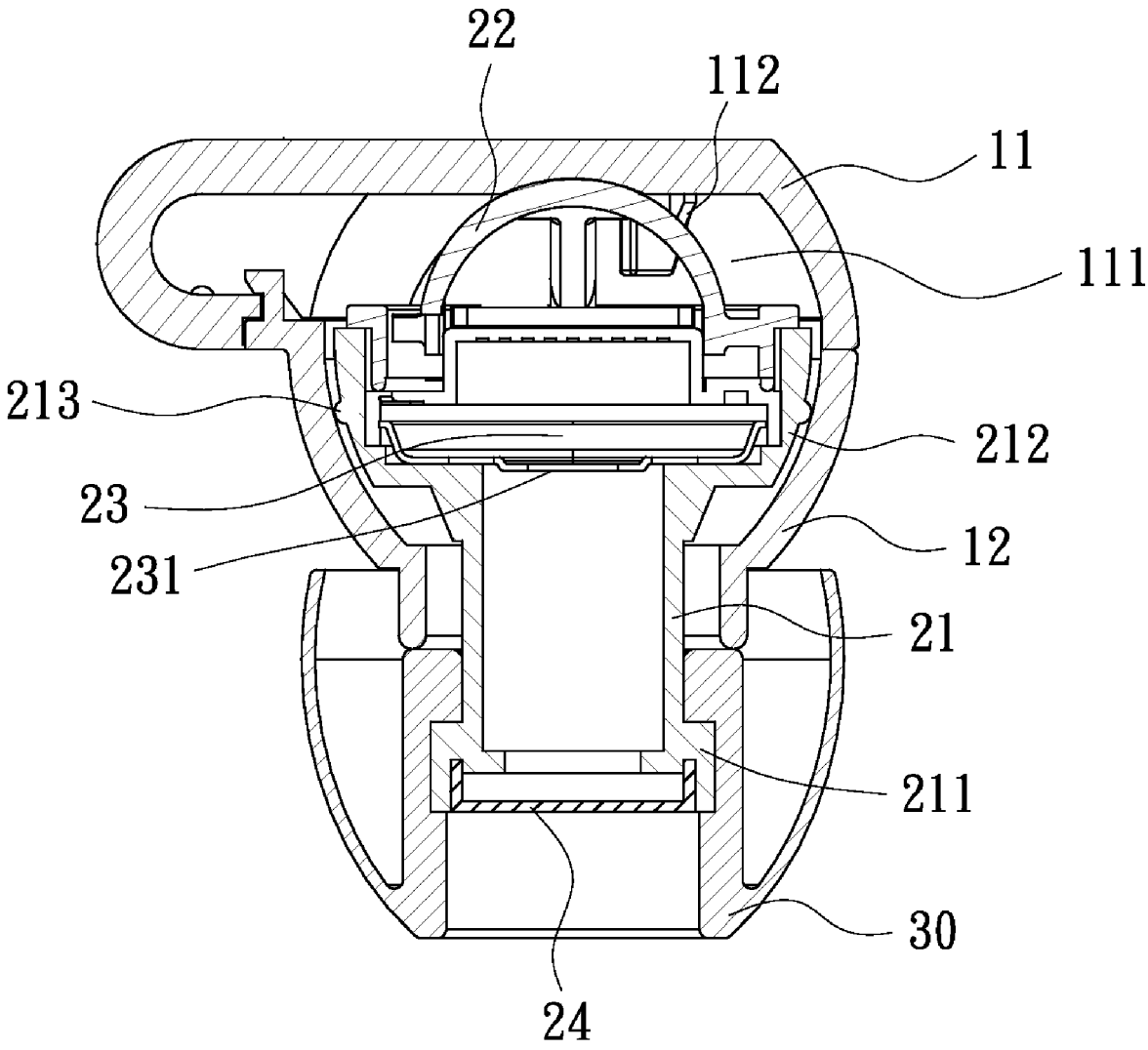
FIG. 3 is a cross-sectional view of the in-ear earphone depicted in FIG. 1.
Figure 4:
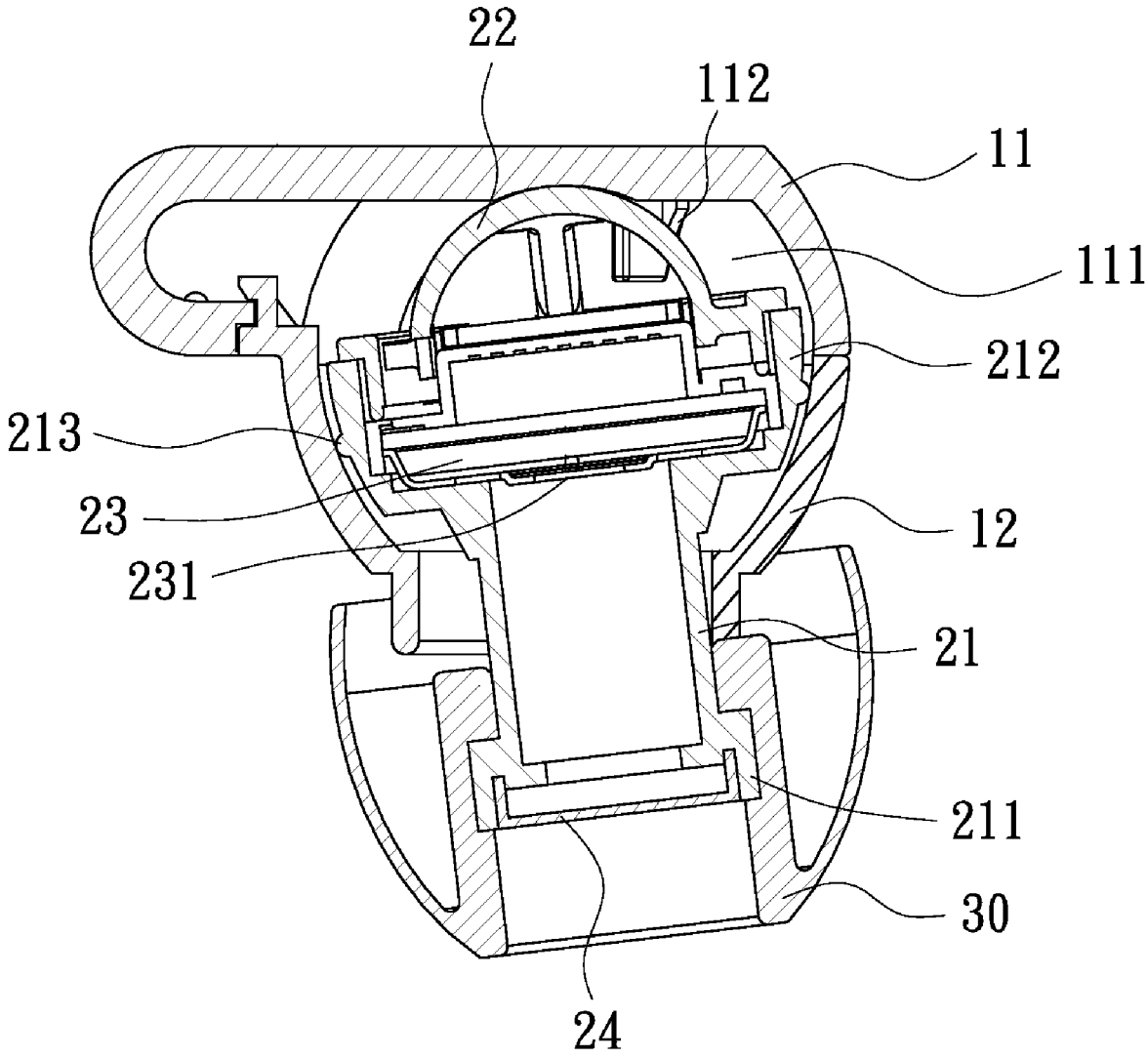
FIG. 4 is another cross-sectional view of the in-ear earphone depicted in FIG. 1, wherein the sound output device is adjusted by an angle relative to the shell.

Referring to FIG. 3 and FIG. 2, a plurality of protrusions 213 are formed on an outer wall of the containing portion 212 of the sound tunnel 21. The protrusions 213 touch the inner wall of the cover 12. Referring to FIG. 4, when the user pushes the sound output device 20 so that there is an angle between the sound output device 20 and the shell 10, the protrusions 213 on the sound tunnel 21 rub the inner wall of the cover 12 accordingly, so as to prevent excessive movement of the sound output device 20.

It is to be understood that because the speaker 23 is coaxially disposed on the containing portion 212 of the sound tunnel 21 along with the sound tunnel 21, no matter how the sound output device 20 changes its angle relative to the shell 10, the sound outputting surface 231 of the speaker 23 is always exactly facing the opening end 211.

Figure 5:
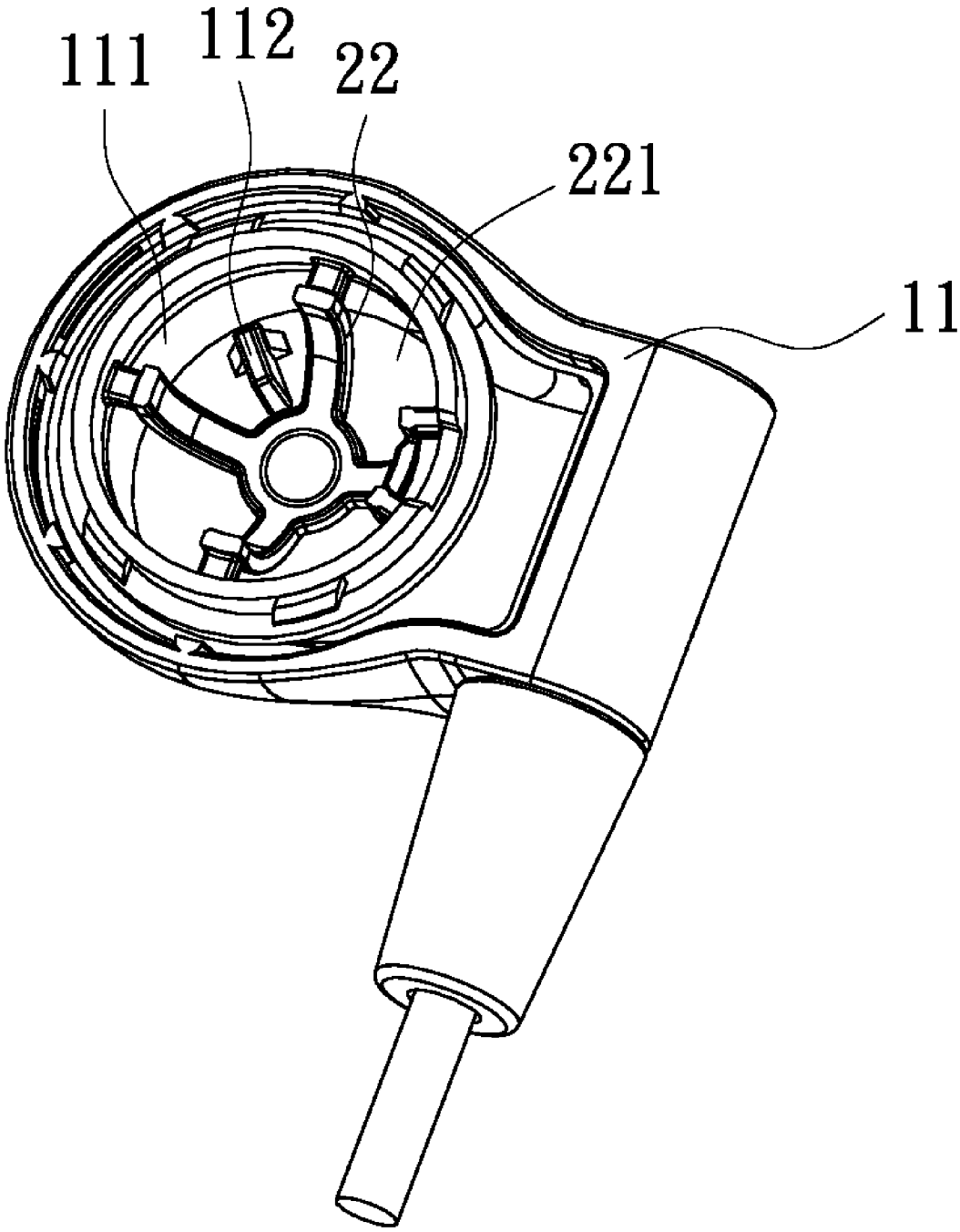
FIG. 5 is a magnified view of a portion of the in-ear earphone depicted in FIG. 1.

Referring to FIG. 5, the four positioning holes 221 are formed through the second engaging portion 22. A stopping device 112 is fixedly disposed on the base 11. When the second engaging portion 22 moves relative to the base 11, the range of its movement is limited by the positioning holes 221, that is, when the second engaging portion 22 moves to a position where it touches with the stopping device 112 or the positioning hole 221, the second engaging portion 22 can not move in the same direction any more. In that case, the second engaging portion 22 can only move in an opposite direction. Thus, excessive angular movement of the sound output device 20 relative to the shell 10 can be prevented.

Figure 6:
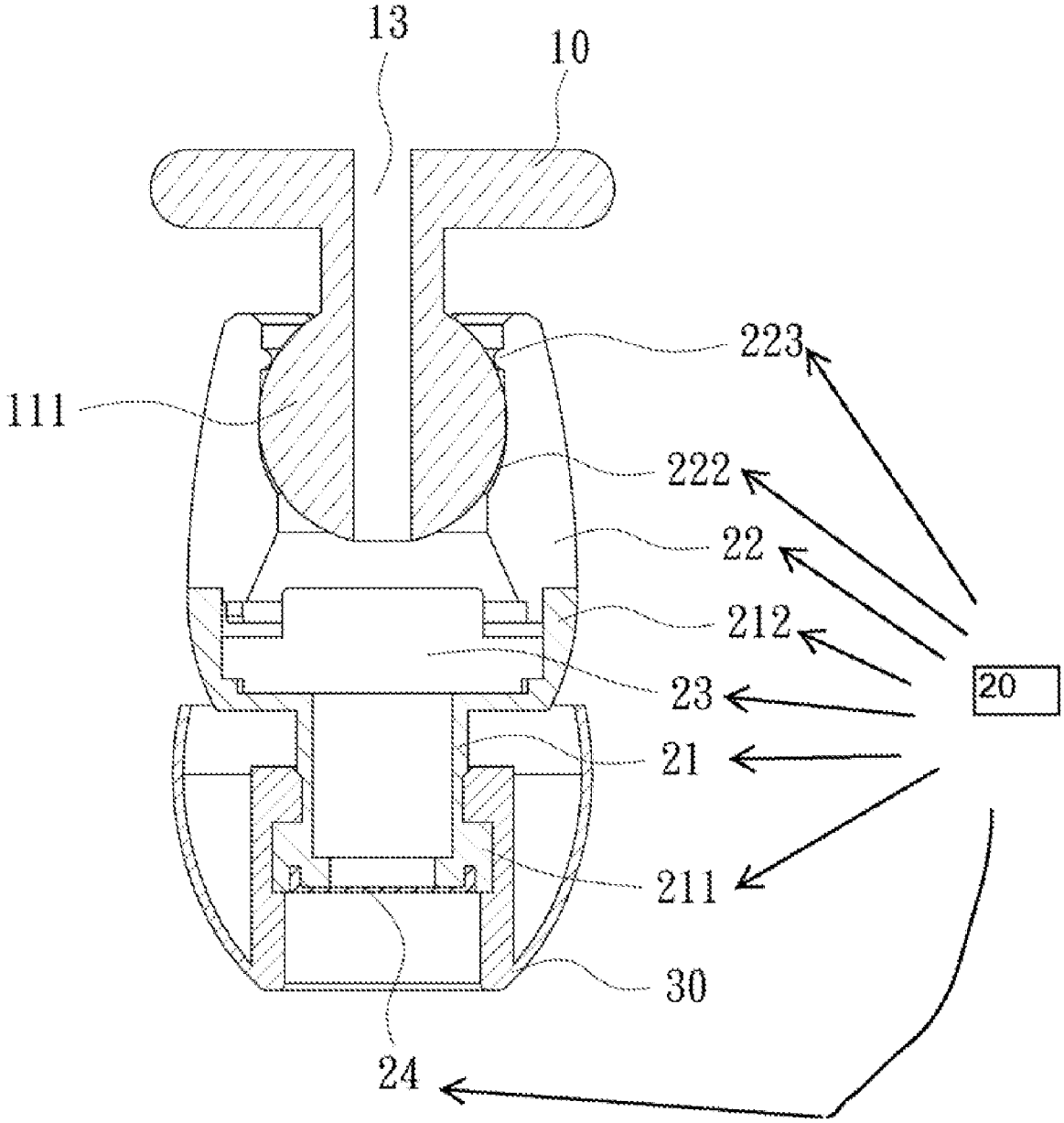
FIG. 6 is a cross-sectional view of an in-ear earphone according to another preferred embodiment of the present invention.

Referring to FIG. 6, another embodiment of the present invention is provided. In this embodiment, the first engaging portion 111 is monolithically formed to be extended from the shell 10, and has a shape close to a ball. A wire groove 13 is disposed through the first engaging portion 111 and the shell 10 so that a wire of the speaker 23 can be pulled out from the wire groove 13. In addition, the second engaging portion 22 of the sound output device 20 has a tube shape. An end of the second engaging portion 22 is connected to the containing portion 212 of the sound tunnel 21 and another end of the second engaging portion 22 has a cell 222, which has a curved surface and is configured for combining with the first engaging portion 111. By the relative movement between the cell 222 and the ball shaped first engaging portion 111, the sound output device 20 can be adjusted in angles toward the shell 10. A plurality of protrusions 223 are formed on the curved surface of the cell 222. When the sound output device 20 changes its angle to the shell 10, the protrusions 223 can prevent any excessive movement by exerting friction force.

In summary, the sound output device, which can be plugged into a user's canal, of the in-ear earphone according to the embodiments of the present invention can be adjusted in its angle with the shell of the earphone so that when different users use the earphone, the users can adjust the sound output device to make it fit their ear canals. Because the speaker is disposed in the sound output device, the direction in which the speaker outputs sound to the sound tunnel do not vary with the angular adjustment of the sound output device. As a result, the sound output characteristics of the earphone are not disturbed by the adjustment. In addition, the configuration of the positioning holes of the second engaging portion and the stopping device and the configuration of the protrusions on the sound tunnel and the first engaging portion can prevent excessive angular adjustments between the sound output device and the shell so as to avoid unintended adjustments and inability of positioning during use.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An in-ear earphone comprising:

a shell comprising a base and a cover connected to the base, the cover having a substantially half spherical inner surface, a first engaging portion being formed in the shell; and a sound output device comprising a sound tunnel, a second engaging portion and a speaker, the sound tunnel comprising an opening end at one end and a containing portion at another end, the containing portion being received in the shell, the opening end being exposed to an outside of the shell, the speaker being accommodated in the containing portion and disposed coaxially with the sound tunnel, the second engaging portion being received in the shell and covering the containing portion of the sound tunnel, the speaker being disposed between the sound tunnel and the second engaging portion, the containing portion having a curved outer surface, the curved outer surface of the containing portion being movably engaged with the half spherical inner surface of the cover and the second engaging portion being movably engaged with the first engaging portion such that an angle between the shell and the sound output device is adjustable by the curved outer surface of the containing portion moving relative to the half spherical inner surface of the cover and the second engaging portion moving relative to the first engaging portion, whereby the sound tunnel is suitably plugged into individual user's ear canals.

2. The in-ear earphone of claim 1, wherein the base also has a substantially half spherical inner surface and the half spherical inner surfaces of the base and the cover are combined to form a ball shaped cell in the shell, the ball shaped cell functioning as the first engaging portion.

3. The in-ear earphone of claim 1, wherein a plurality of protrusions are formed on an outer wall of the containing portion and movably engaged with the half spherical inner surface of the cover.

4. The in-ear earphone of claim 1, wherein the second engaging portion has a half spherical surface movably engaged with the base of the shell.

5. The in-ear earphone of claim 4, wherein at least a stopping device is formed on the base, at least a positioning hole is formed on the second engaging portion, the at least a stopping device is inserted into the at least a positioning hole and the angular adjustment between the shell and the sound output device is limited between the at least a stopping device and the at least a positioning hole.

6. The in-ear earphone of claim 1, wherein the sound tunnel has an opening end and a containing portion, the opening end being exposed to an outside of the shell, the containing portion begin configured for accommodating the speaker.

7. The in-ear earphone of claim 6, wherein the second engaging portion has a tube shape, an end of the second engaging portion being engaged to the containing portion of the sound tunnel, another end of the second engaging portion having the cell for combining with the first engaging portion.

8. The in-ear earphone of claim 7, wherein a plurality of protrusions are formed in the cell for blocking an angular adjustment between the sound output device and the shell.

9. The in-ear earphone of claim 1, wherein the sound tunnel is made of polyoxymethylene (POM), and the second engaging portion is made of acrylonitrile butadiene styrene (ABS).

10. The in-ear earphone of claim 1, wherein a grid cover is disposed inside the opening end of the sound tunnel of the sound output device for preventing dust from entering the sound tunnel.

11. The in-ear earphone of claim 1, wherein the outside of the sound tunnel is wrapped around by a cushion, the cushion being made of an elastic material and suitable for being plugged into user's ear canals.

12. An in-ear earphone comprising:

a shell having a first engaging portion formed in the shell; and a sound output device comprising a sound tunnel, a second engaging portion and a speaker, the sound tunnel comprising an opening end at one end and a containing portion at another end, the speaker being accommodated in the containing portion and disposed coaxially with the sound tunnel, the second engaging portion being connected with the containing portion and having a curved inner surface, the speaker being disposed between the sound tunnel and the second engaging portion, the first engaging portion being received in the second engaging portion and having a ball shaped outer surface, the curved inner surface of the second engaging portion being movably engaged with the ball shaped outer surface of the first engaging portion such that an angle between the shell and the sound output device is adjustable by the curved inner surface of the second engaging portion moving relative to the ball shaped outer surface of the first engaging portion whereby the sound tunnel is suitably plugged into individual user's ear canals, wherein the first engaging portion is monolithically formed to be extended from the shell, and a wire groove is disposed through the first engaging portion and the shell.

* * * * *